US006857963B1

(12) United States Patent
Suzuki

(10) Patent No.: US 6,857,963 B1
(45) Date of Patent: Feb. 22, 2005

(54) CONJURING TOOL FOR PERFORMING CARD TRICK

(75) Inventor: Toru Suzuki, Tokyo (JP)

(73) Assignee: Tenyo Co., Ltd., Tokyo (JP)

( * ) Notice: Subject to any disclaimer, the term of this patent is extended or adjusted under 35 U.S.C. 154(b) by 0 days.

(21) Appl. No.: 10/827,280

(22) Filed: Apr. 20, 2004

(30) Foreign Application Priority Data

Sep. 5, 2003 (JP) ..... 2003-313833

(51) Int. Cl.[7] ..... A63J 5/02
(52) U.S. Cl. ..... 472/63; 472/71; 40/427
(58) Field of Search ..... 472/57, 63, 71; 40/427, 436, 437, 438, 445

(56) References Cited

U.S. PATENT DOCUMENTS 1,219,731 A * 3/1917 Hall ..... 40/443
1,762,501 A * 6/1930 Brehmer ..... 472/71
3,661,385 A * 5/1972 Schneider ..... 472/63
4,565,364 A * 1/1986 Kondo ..... 472/69
5,348,220 A * 9/1994 Setteducati ..... 232/1 D
5,467,871 A * 11/1995 DeField ..... 206/232
6,070,350 A * 6/2000 Fantone et al. ..... 40/454
6,191,700 B1 * 2/2001 Cardona ..... 340/815.55
6,226,906 B1 * 5/2001 Bar-Yona ..... 40/454

* cited by examiner

*Primary Examiner*—K. T. Nguyen
(74) *Attorney, Agent, or Firm*—Swidler Berlin LLP

(57) ABSTRACT

In order to provide a conjuring tool which is simple in construction and operation, there is provided a conjuring tool for performing a card trick wherein a recessed accommodating portion 32 for accommodating therein a note or card that is inserted thereinto from the outside of the conjuring tool is formed in the interior of the conjuring tool, wherein there are provided an open window portion 12 for allowing the note or card that has been so inserted into the recessed accommodating portion 32 to be viewed from the outside of the conjuring tool via a special plate 20 that has an effect of making a viewer feel a certain degree of depth due to a three-dimensional pattern produced by a moire phenomenon and a film 33 disposed between the note or card so inserted and the special plate 20 and having transparent portions and non-transparent portions, and wherein the film 33 is arranged to move on the note or card.

3 Claims, 7 Drawing Sheets

CONJURING TOOL FOR PERFORMING CARD TRICK

BACKGROUND OF THE INVENTION

1. Technical Field

The present invention relates to a conjuring tool using a note or card, and more particularly to a conjuring tool for performing a card trick which can give a viewer an illusion that a note or card that is inserted into a box disappears gradually in front of the viewer and part of the note or card that has so disappeared reappears gradually in front of the viewer.

2. Description of the Related Art

Conventionally, there have existed conjuring tools for performing a trick in which every object including a note and a card is accommodated in a box and a lid is closed, and when the lid is then opened, the object that should remain in the box is found to have disappeared momentarily, and when the lid is closed again and is then reopened, the object that disappeared just now is found to have reappeared in the box.

Note that the conventional conjuring tools have been open to the general public, and the applicant for this invention possesses or has seen the publicly open conjuring tools but does not have documents that describe the related art, and therefore, there is disclosed herein no document that describes the related art for the invention.

However, there has existed no conjuring tool for performing a trick in which an object is made to disappear gradually in front of the viewer and then part of the object that disappeared just now is made to reappear gradually in front of the viewer, the trick being different from the conventional one in which an object is made to disappear and then to reappear after the lid is closed so as to conceal the object from the eyes of the viewer.

Moreover, there has existed no such conjuring tool that is simple in construction and operation.

SUMMARY OF THE INVENTION

Then, an object of the present invention is to provide a conjuring tool which uses a note or card for performing a trick which can give a viewer an illusion that a note or card that is inserted into a box disappears gradually in front of the viewer and part of the note or card that disappeared just now then reappears gradually in front of the viewer, and which is simple in construction and operation.

With a view to attaining the object, according to the present invention, there is provided a conjuring tool for performing a card trick wherein a recessed accommodating portion for accommodating therein a note or card that is inserted thereinto from the outside of the conjuring tool is formed in the interior of the conjuring tool, wherein there are provided an open window portion for allowing the note or card that has been so inserted into the recessed accommodating portion to be viewed from the outside of the conjuring tool via a special plate that has an effect of making the viewer feel a certain degree of depth due to a three-dimensional pattern produced by a moire phenomenon and a film disposed between the note or card so inserted and the special plate and having transparent portions and non-transparent portions, and wherein the film is arranged to move on the note or card.

In addition, in the conjuring tool for performing a card trick, the recessed accommodating portion is formed between two rollers that are provided in parallel in the interior of the conjuring tool, and the film may be attached to the two rollers so that the whole of the film is moved via the rollers, whereby the film is allowed to move on the note or card.

Furthermore, in the conjuring tool for performing a card trick, the film surrounds the recessed accommodating portion in a direction which intersects at right angles with a direction in which the note or card is inserted, the film is extended between the two rollers in such a manner that part of the film that passes along a backside of the conjuring tool passes between the recessed accommodating portion and a bottom side of the conjuring tool, and an open operating window portion is provided in the bottom side of the conjuring tool for allowing the part of the film that passes along the back side of the conjuring tool to be exposed, so that the whole of the film can be moved via the rollers when an operator moves with his or her finger the part of the film that passes along the back side of the conjuring tool in a direction which is normal to an axial direction of the rollers.

According to the conjuring tool for performing a card trick of the present invention, it is possible to impart the viewer wonder in which the note or card inserted into the box disappears gradually in front of the viewer and part of the note or card that disappeared just now appears gradually in front of the viewer. Furthermore, since the conjuring tool for performing a card trick according to the present invention is simple in construction and operation, there is provided an advantage wherein even a child who has no skillful technique can perform a trick easily by using the conjuring tool for performing a card trick according to the invention.

DESCRIPTION OF THE PREFERRED EMBODIMENTS

Referring the accompanying drawings, an embodiment of a conjuring tool for performing a card trick according to the invention will be described below.

Construction of Conjuring Tool for Performing a Card Trick

Firstly, the construction of a conjuring tool 1 for performing a card trick according to the embodiment will be described by reference to FIGS. 1 to 4.

Figure 2:
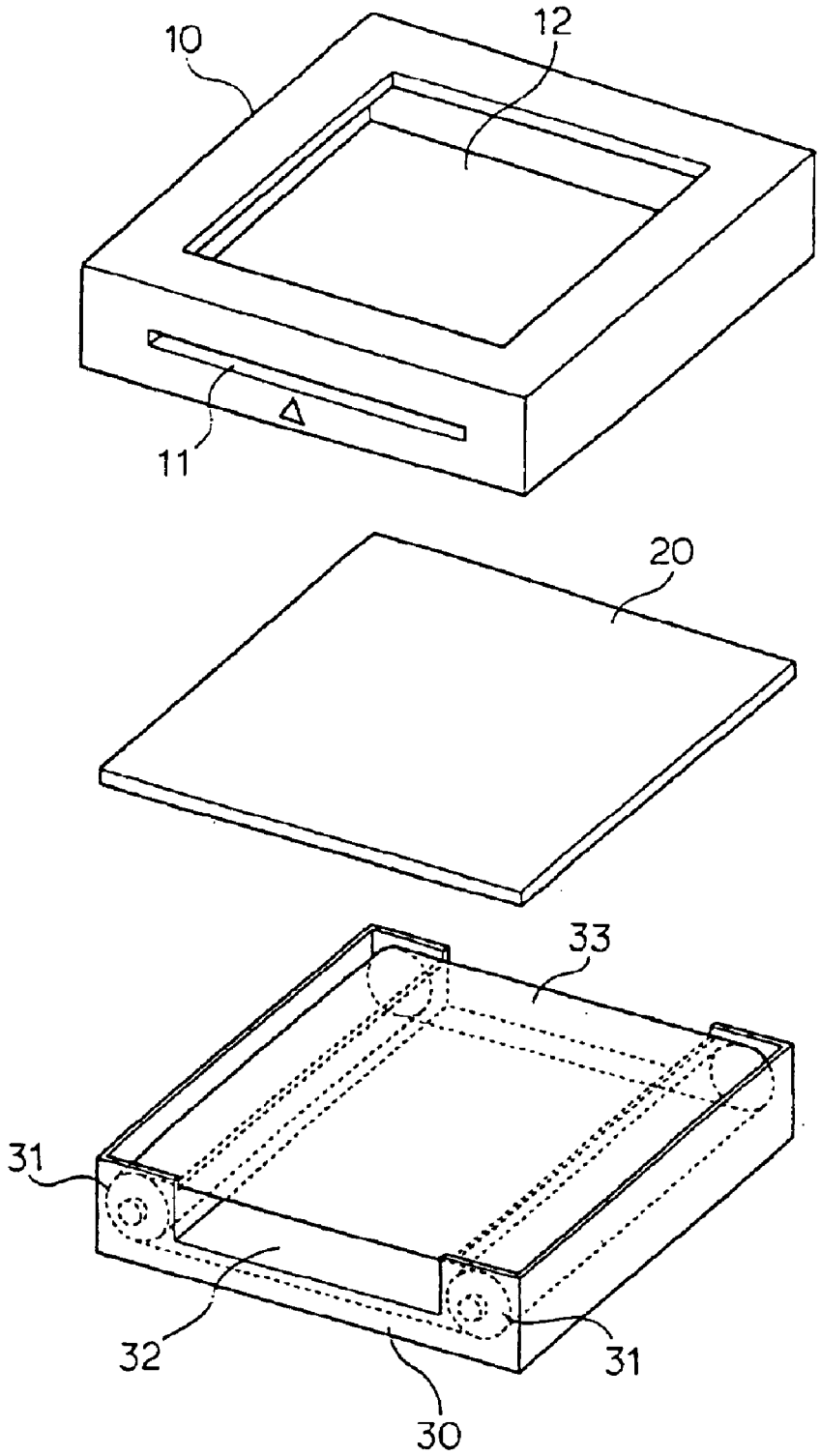

The conjuring tool 1 for performing a card trick or card trick performing conjuring tool 1 according to the embodiment includes, as shown in FIG. 2, a frame case 10, a special plate 20 and a base 30.

Next, the respective constituent elements of the card trick performing tool 1 will be described below.

Frame Case

The frame case 10 is constructed so as to cover the base 30. Then, an insertion opening 11 is formed in at least one side of the frame case 10 as shown in FIG. 2 for insertion of a note or card, which will be described later on. In addition, an open window portion 12 is formed in an upper side (a front side) of the frame case 10 for allowing the viewer to view a note or card that is inserted in the tool.

Special Plate

The special plate 20 is such as to produce a three-dimensional pattern thereon. When the viewer looks at this special plate 20 from the front side thereof, it looks to the viewer as if the three-dimensional pattern had a certain depth and was receding deeper than the surface of the special plate 20 to thereby provide a three-dimensional feeling.

Note that while in this embodiment, a dot-like three-dimensional pattern is produced, the form of the three-dimensional pattern can be selected arbitrarily.

In addition, as a special plate that can provide such an effect, Japanese Patent No. 3131771 discloses one which produces a three-dimensional pattern by a moire phenomenon for example.

Base

The base 30 has two rollers 31 which are mounted thereon in such a manner that axial directions of the respective rollers 31 become parallel with each other. Then, a recessed accommodating portion 32 is formed between the two rollers 31 so mounted for accommodating therein a note or card that is inserted as will be described later on.

Figure 3:
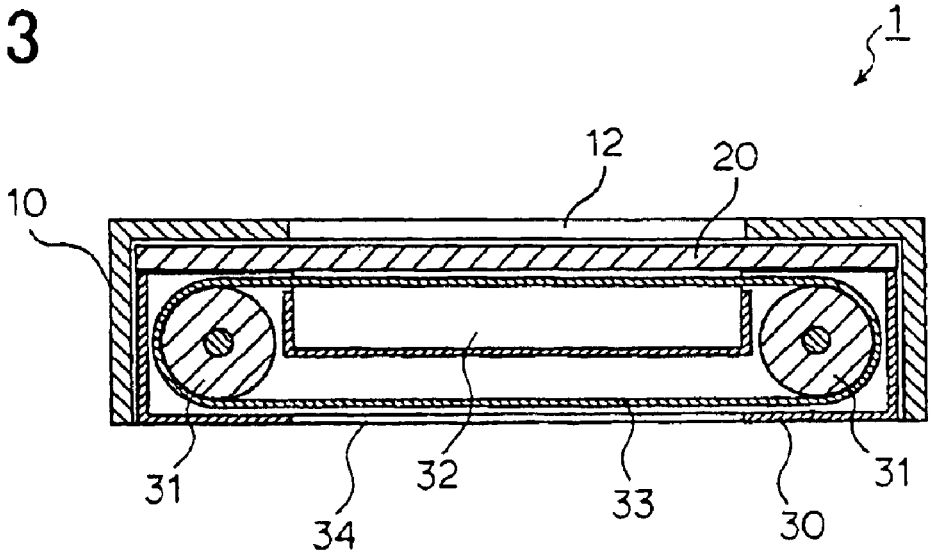
FIG. 3 is a cross-sectional view showing an internal construction of the conjuring tool for performing a card trick shown in FIG. 1.

In addition, a film 33 having transparent portions and non-transparent portions is extended between the two rollers 31, as shown in FIGS. 2 and 3, in such a manner as to surround the recessed accommodating portion in a direction which becomes normal to the axial direction of the rollers and in such a manner that part of the film 33 that passes along a back side of the conjuring tool passes between the recessed accommodating portion and a bottom side of the conjuring tool.

To be specific, the film 33 is extended between the two rollers 31 in such a manner that part of the film that passes along a front side of the conjuring tool covers the recessed accommodating portion 32, whereas the part of the film 33 that passes along the back side of the conjuring tool passes between the recessed accommodating portion 32 and the bottom side (the back side) of the base 30.

Figure 4:
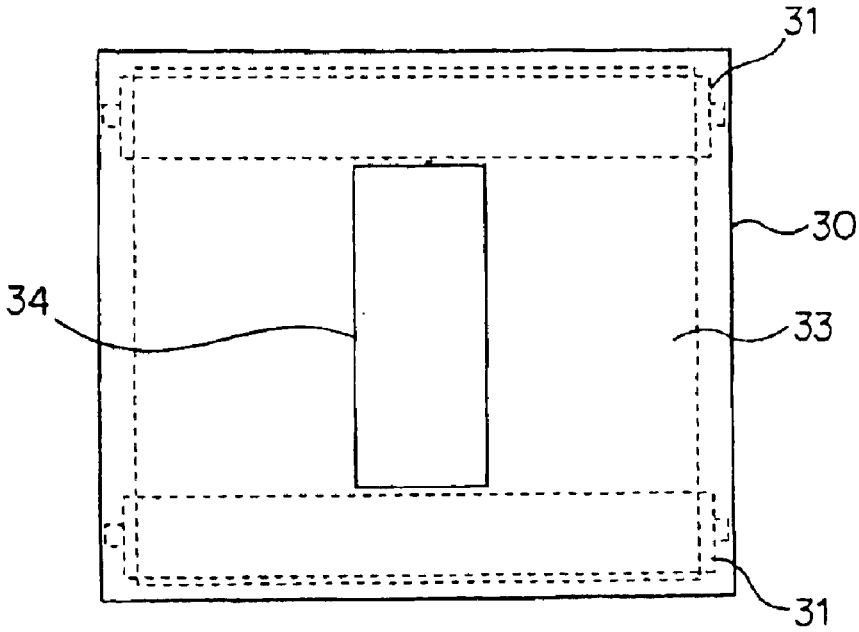
FIG. 4 is a bottom view of the conjuring tool for performing a card trick shown in FIG. 1.

Furthermore, an open operating window 34 is, as shown in FIG. 4, formed in the bottom side of the base 30 for allowing the part of the film 33 that passes along the back side of the conjuring tool to be exposed. With this open operating window portion so formed, the operator can move the part of the film that passes along the back side of the conjuring tool in a direction which intersects with the axial direction of the rollers 31 substantially at right angles with his or her finger, and as a result, the operator can move the whole of the film 33 via the rollers 31.

Note that in this embodiment, the description will be made based on the understanding that a film in which a gradation pattern is provided on a transparent film is used as the film 33. In addition, the color of the non-transparent portions of the film 33 or the gradation pattern needs to be identical to that of a bottom surface of the recessed accommodating portion 32.

Assembly of Respective Constituent Elements

Figure 1:
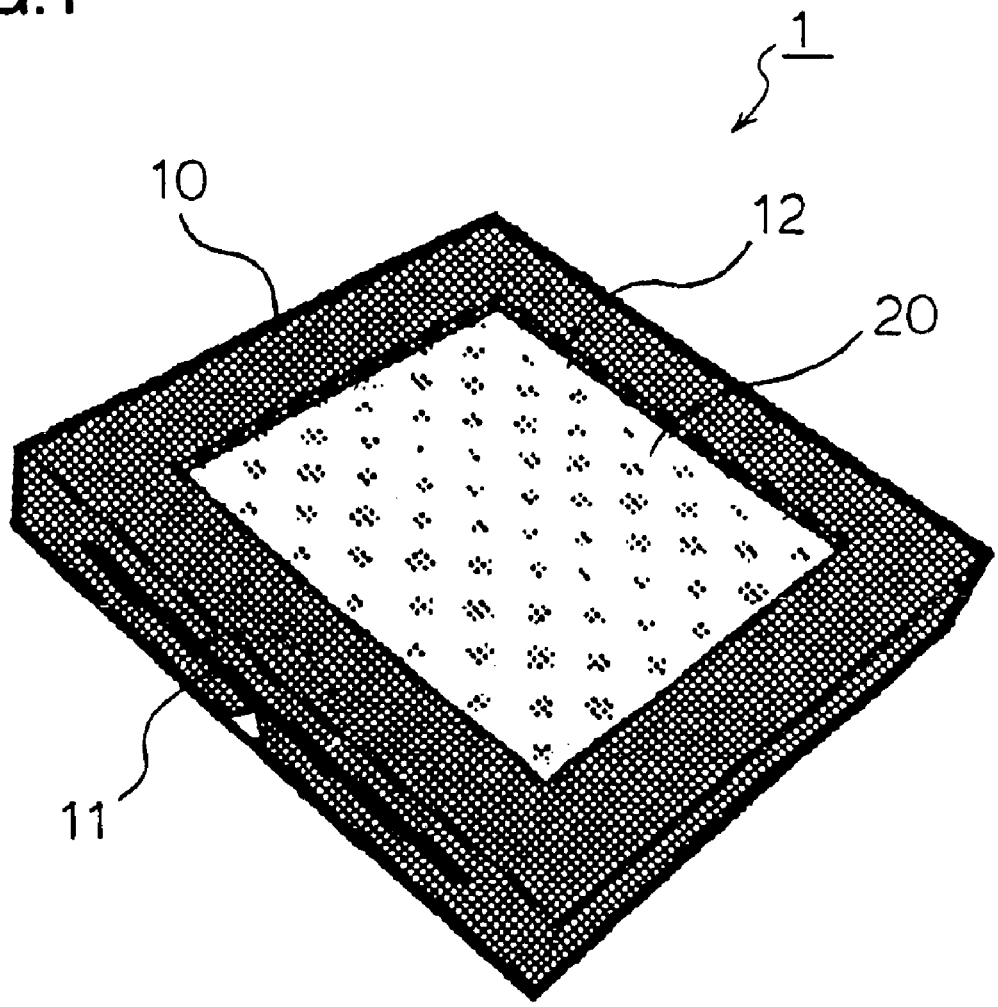
FIG. 1 is a perspective view showing a conjuring tool for performing a card trick according to the invention, FIG. 2 an exploded view showing constituent elements of the conjuring tool for performing a card trick shown in FIG. 1.

Then, the card trick performing conjuring tool 1 shown in FIG. 1 is completed by assembling the respective constituent components that have been described above in the following manner.

Firstly, the special plate 20 is placed on the base 30 that is constructed as described above. Next, the frame case 10 is placed on the base 30 on which the special plate 20 is rested from thereabove in such a manner as to cover the base 30. As this occurs, the frame case 10 is placed to cover the base 30 in such a manner that the insertion opening 11 provided in the frame case 10 is positioned at the opening in the side of the recessed accommodating portion 32.

By following this procedure, the recessed accommodating portion 32 is covered with the gradation film 33, the special plate 12 and the open window portion 12 in that order from the bottom. Then, by assembling the constituent components in this manner, the card trick performing conjuring tool 1 shown in FIG. 1 can be completed.

Note that while in this embodiment, the special plate is described as being separate from the frame case, the special plate may be constructed to be fitted in the open window portion in the frame case.

Procedure for Operating the Card Trick Performing Conjuring Tool

Next, described below by reference to FIGS. 5 to 7 will be an example of a procedure for performing a conjuring trick using the card trick performing conjuring tool 1 that is constructed as has been described above. Note that in this embodiment, a procedure for performing a conjuring trick using a note 100 will be described.

Firstly, before starting a conjuring trick, the operator moves with his or her finger the part of the gradation film 33 that passes along the back side of the conjuring tool 1 and which is exposed in the open operating window portion 34 in the direction which is substantially normal to the axial direction of the rollers 31 so that the unpainted transparent portions of the gradation film 33 are positioned within the open window portion 12. Then, in this state, the operator starts a conjuring trick in the following procedure.

Figure 5:
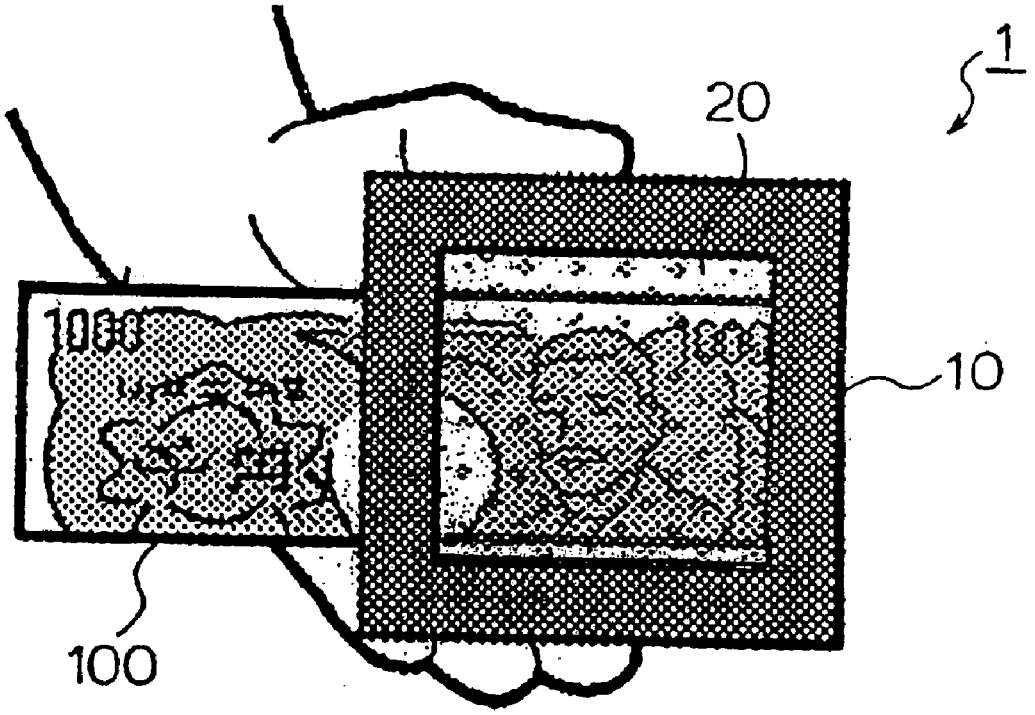
FIG. 5 is a view showing a state in which a note is inserted into the conjuring tool for performing a card trick according to the invention.

Firstly, the operator inserts, as shown in FIG. 5, a note from the insertion opening 11 into the card trick performing conjuring tool 1. As this occurs, the note 100 so inserted is accommodated in the recessed accommodating portion 32. Note that in this embodiment, the note 100 is folded partially and is then so inserted. Then, the operator allows the viewer to observe the note 100 made to appear in the open window portion 12.

As this occurs, since the viewer who observes the inside of the open window portion 12 sees the note 100 through the special plate 20 that can provide the effect that has been described above, the note 100 within the open window portion 12 looks as if it were transparent.

The principle of thie phenomenon will be described below. Firstly, while the note 100 in the open window portion 12 can be viewed through the special plate 20, according to the effect of the special tool that has been described previously, since the three-dimensional pattern (the dot-like pattern in this embodiment) of the special plate 20 has a certain depth and is seen as if it were receding deeper than the upper surface of the special plate 20, the viewer sees as if dots of the dot-like pattern that are seen to overlap the note 100 existed deeper than the note 100. Thus, the note 100 within the open window portion 12 looks transparent to the viewer from this principle.

Note that, as this occurs, the transparent portions of the gradation film 33 are present between the note 100 in the open window portion 12 and the special plate 20.

Following this, the operator manipulates the finger of the hand that grabs the conjuring tool 1 in such a manner as not to be seen from the viewer and moves the part of the gradation film 33 that passes along the back side of the conjuring tool 1 and which is exposed in the open operating window portion 34 in the direction which is substantially normal to the axial direction of the rollers 31. The whole of the gradation film 33 starts to move from this operation, whereby gradated portions of the gradation pattern which are the non-transparent portions of the gradation film 33 gradually move into the open window portion 12.

Figure 6:
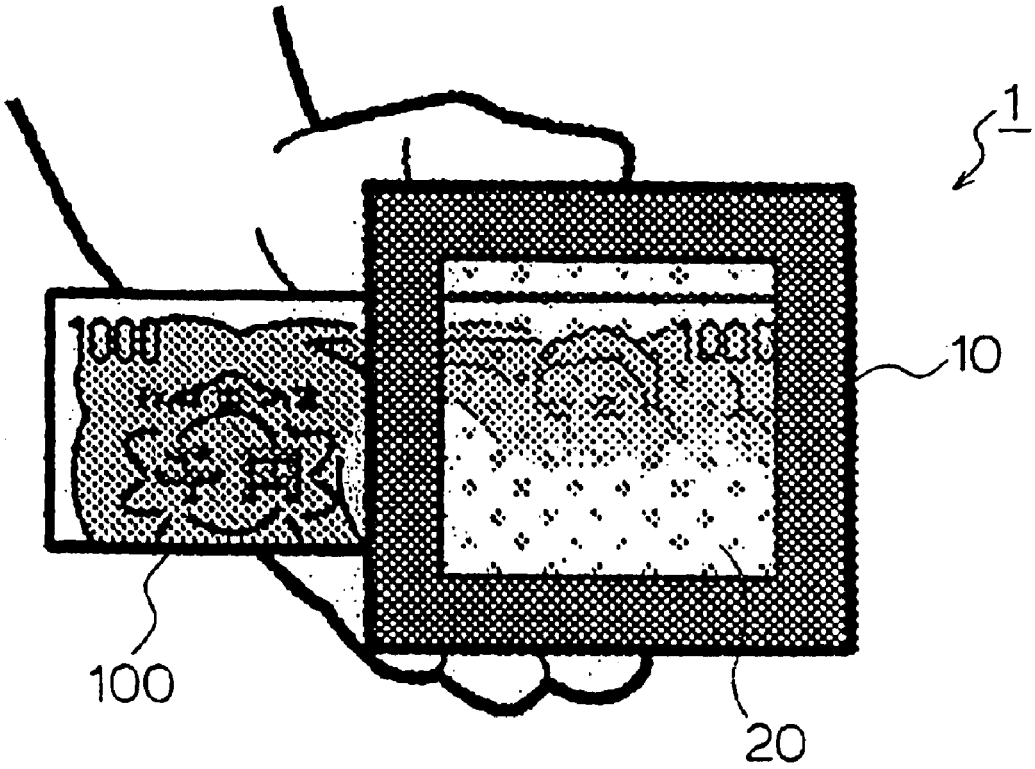
FIG. 6 is a view showing a process in which the note in an open window portion is seen to be disappearing gradually by the operation of the conjuring tool for performing a card trick of the invention.

Then, when the gradated portions come to enter between the note 100 shown in the open window portion 12 and the special plate 20, it looks to the viewer as if the note 100 within the open window portion 12 was disappearing gradually (in this embodiment, gradually from a lower side of the note 100) as shown in FIG. 6, and furthermore, it looks as if the note 100 had disappeared completely at portions of the gradated portions which are darker in color.

The principle of this phenomenon will be described below. When the gradated portions whose color is identical to that of the bottom surface of the recessed accommodating portion 32 and which are thus non-transparent move between the note 100 in the open window portion 12 and the special plate 20, the note 100 in the open window portion 12 is caused to disappear gradually by the gradated portions. As this occurs, however, the dot-like pattern seen in the open window portion 12 is concealed by the gradated portions in no case and exist at the same positions at all times, and moreover, the dot-like pattern continues to be seen to be receding deeper than the surface of the special plate 20, and therefore, it looks to the viewer as if the note 100 in the open window portion 12 were disappearing gradually.

Figure 7:
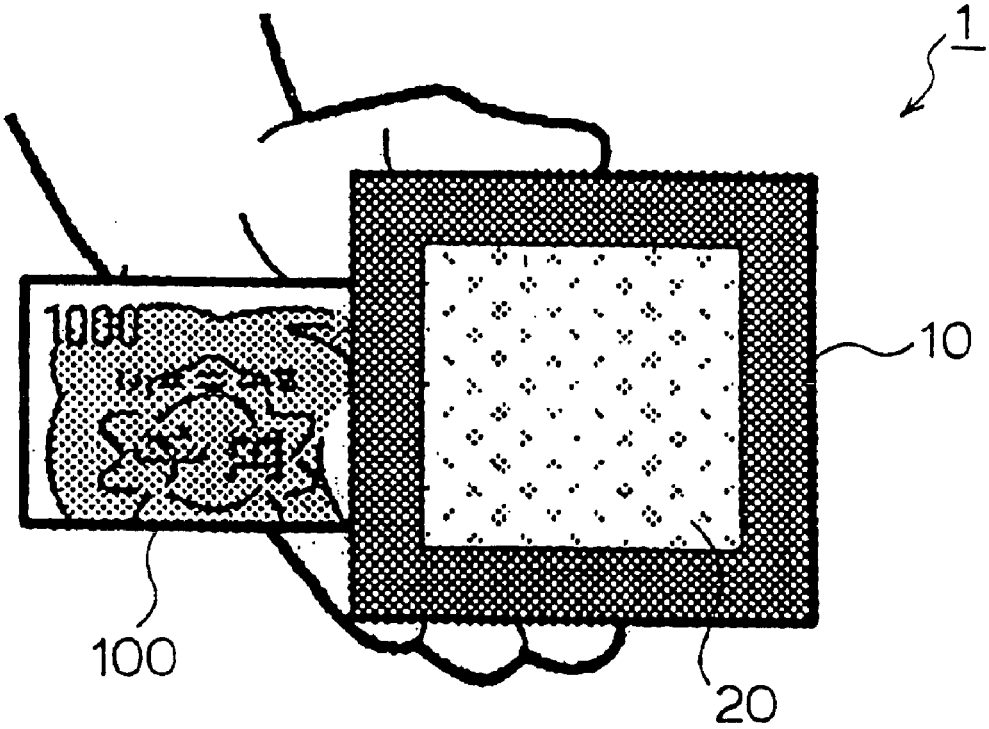
FIG. 7 is a view showing a state in which the note in the open window portion is seen to have disappeared completely by the operation of the conjuring tool for performing a card trick of the invention.

Then, when continuing to move the whole of the gradation film 33 using the finger, since the note 100 within the open window portion 12 is completely concealed by the darker portions of the gradation film 33, it looks to the viewer from the aforesaid principle as if the note 100 within in the open window portion 12 had completely disappeared in the end as shown in FIG. 7. Thus, in this way, an illusion can be given to the viewer in which the note 100 within the open window 12 has gradually disappeared in front of him or her.

Following this, from this state, the operator starts to move with his or her finger the part of the gradation film 33 that passes along the back side of the conjuring tool 1 and which is exposed in the open operating window portion 34 in an opposite direction to the direction in which the gradation film 33 has been moved. Then, this time, the note 100 in the open window portion 12 that has completely disappeared is then allowed to start to appear gradually (in this embodiment, gradually from an upper side of the note 100), and the three-dimensional pattern of the special plate 20 comes to be superposed on the note 100, and passing the state shown in FIG. 6, the whole of the note 100 within the open window portion 12 is allowed to be viewed in the transparent state in the end as shown in FIG. 5 which shows the state in which the note 100 is initially inserted into the conjuring tool 1.

Thus, the viewer can be given an illusion from the aforesaid principle in which the note 100 in the open window portion 12 that has gradually disappeared in front of him or her has now gradually reappeared in front of him or her.

Figure 8A:
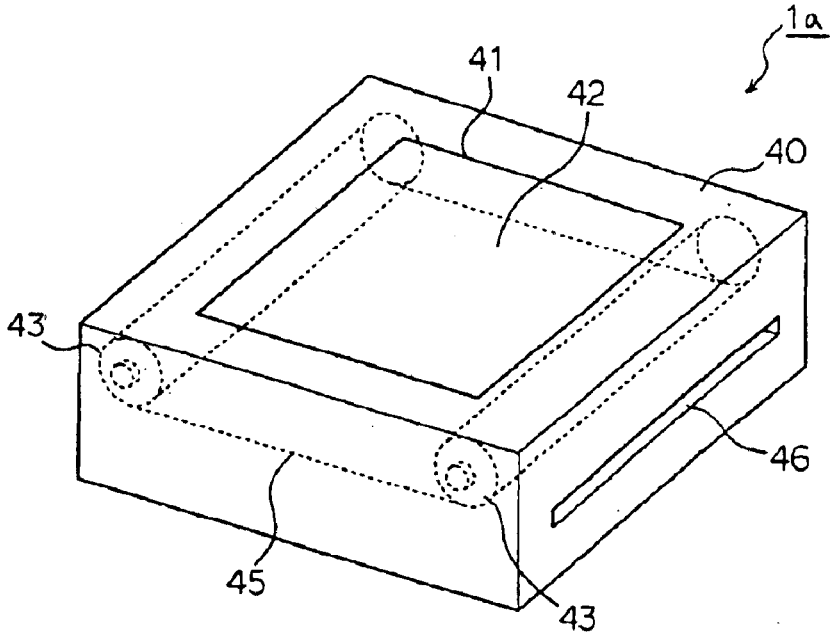
FIG. 8 shows another embodiment of a conjuring tool for performing a card trick, in which FIG. 8(*a*) is a drawing showing the construction of a base in the embodiment, and FIG. 8(*b*) is a drawing showing a state in which a note is inserted into the conjuring tool using the base.
Figure 8B:
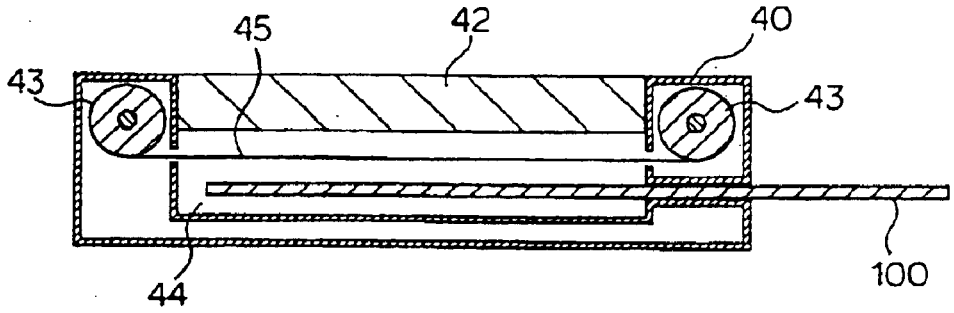

Note that as another embodiment, the construction of the conjuring tool 1 may be modified to one shown in FIG. 8. To be specific, in a conjuring tool 1*a* shown in FIG. 8, a open window portion 41 is provided in an upper side (a front side) of a case main body 40 which takes a form resulting from the integration of the frame case 10 and the base 30 in the embodiment described with reference to FIGS. 1 to 4 into a single unit, and a special plate 42 that provides a similar effect to that of the special plate 20 in the previous embodiment is fitted in the open window portion 41.

In addition, two rollers 43 are mounted in the interior of the case main body 40 in such a manner that axial directions of the rollers 43 become parallel with each other, and a recessed accommodating portion 44 is formed between the respective rollers 43 so mounted. In addition, a through opening 46 is provided in a side of the case main body in which the rollers 43 are mounted in such a manner as to allow a note 100 or card to pass underneath the rollers 43.

Furthermore, a film 45, which is similar to that of the previous embodiment, is extended between the two rollers 43 in such a manner as to pass between the note 100 and the special plate 42 as shown in FIG. 8(*b*). Then, by constructing the conjuring tool 1*a* as has been described above, non-transparent portions and a gradation pattern on the film 45 can be moved in a parallel direction to a direction in which the note 100 or a card is inserted.

In addition, while, in the previous embodiment, the operator moves the film 33 with his or her finger, the rollers 31, 43 may be electrically rotated so as to move the film 33, 45. In this case, for example, a motor for rotating the rollers 31, 43 and a power supply such as a battery for operating the motor need to be incorporated within the conjuring tool 1, and a switch for switching the rotational direction of the motor also needs to provided on a bottom portion of the base 30 and the case main body 40, whereby since the operator can move the film 33, 45 by actuating the motor by operating the switch in such a manner as not to be seen by the viewer to thereby control the rotation of the rollers 31, 43, even a beginner who cannot move his or her finger smoothly can attain the effect provided by the conjuring tool 1 easily.

In addition, while, in the embodiments, the film 33, 45 is moved via the two rollers, end portions of the film 33, 45 or strings connecting to the end portions of the film 33, 45, respectively, may be made to be exposed to the outside of the conjuring tool, so that the film 33, 45 can be moved by holding to pull the end portions of the film 33, 45 or the strings connecting thereto.

What is claimed is:

1. A conjuring tool for performing a card trick, wherein a recessed accommodating portion which is a space for accommodating therein a note or card that is inserted thereinto from the outside of the conjuring tool or a note or card that has been inserted in advance is formed in the interior of the conjuring tool, wherein there are provided;

an open window portion for allowing the note or card that has been so inserted into the recessed accommodating portion to be viewed from the outside of the conjuring tool via a special plate that has an effect of making a viewer feel a certain degree of depth, and a film disposed between the note or card so inserted and the special plate and having transparent portions and non-transparent portions, and wherein the film is arranged to move on the note or card.

2. A conjuring tool for performing a card trick as set forth in claim 1, wherein the recessed accommodating portion is formed between two rollers that are provided in parallel in the interior of the conjuring tool, and wherein the film is attached to the two rollers, whereby the film is allowed to move on the note or card by moving the whole of the film via the rollers.

3. A conjuring tool for performing a card trick as set forth in claim 2, wherein the film surrounds the recessed accommodating portion in a direction which intersects at right angles with a direction in which the note or card is inserted, and the film is extended between the two rollers in such a manner that part of the film that passes along a back side of the conjuring tool passes between the recessed accommodating portion and a bottom side of the conjuring tool, and wherein an open operating window portion is provided in the bottom side of the conjuring tool for allowing the part of the film that passes along the back side of the conjuring tool to be exposed, whereby the whole of the film can be moved via the rollers when an operator moves with his or her finger the part of the film that passes along the back side of the conjuring tool in a direction which is substantially normal to an axial direction of the rollers.

* * * * *